United States Patent [19]

Nosaka et al.

[11] Patent Number: 4,915,246

[45] Date of Patent: Apr. 10, 1990

[54] NON-VENT TYPE FULLY OPENABLE EASY-OPENING END

[75] Inventors: Shoji Nosaka; Tsuyoshi Kawano; Hidenobu Anami; Shinji Tanimoto, all of Kitakyushu, Japan

[73] Assignee: 501 Nippon Steel Corporation, Tokyo, Japan

[21] Appl. No.: 266,956

[22] Filed: Nov. 3, 1988

[30] Foreign Application Priority Data

| | | | |
|---|---|---|---|
| Nov. 4, 1987 | [JP] | Japan | 62-279965 |
| Nov. 4, 1987 | [JP] | Japan | 62-279966 |
| Nov. 25, 1987 | [JP] | Japan | 62-298047 |

[51] Int. Cl.[4] ..... B65D 17/34

[52] U.S. Cl. ..... 220/270; 220/276

[58] Field of Search ..... 220/267, 269, 270, 271, 220/272, 273, 276

[56] References Cited

U.S. PATENT DOCUMENTS

| | | | |
|---|---|---|---|
| 3,478,918 | 11/1969 | Zundel | 220/273 |
| 3,618,815 | 11/1971 | Heffner | 220/269 |
| 3,712,503 | 1/1973 | Zundel | 220/273 |
| 3,838,788 | 10/1974 | Stargell | 220/271 |
| 3,858,753 | 1/1975 | Brantigam | 220/273 |
| 3,891,117 | 6/1975 | Dragomier et al. | 220/270 |

FOREIGN PATENT DOCUMENTS

| | | |
|---|---|---|
| 2178905 | 11/1973 | France . |
| 2236740 | 2/1975 | France . |

*Primary Examiner*—Stephen Marcus
*Assistant Examiner*—Nora Stucker
*Attorney, Agent, or Firm*—Pollock, Vande Sande & Priddy

[57] ABSTRACT

A non-vent type fully openable easy-opening end has a principal score around the periphery of the end, and a pair of beads which run in a tearing direction. The pair of beads is formed symmetrically at both sides of a tab securing portion of the end which is in the vicinity of the tab securing score. A pair of second beads may also be formed on the periphery of a removable portion of the end which is defined by the principal score in such a manner that they run along the principal score. The second beads are located symmetrically on both sides of the tab securing portion. A straight line l that connects the forward end of the tab securing portion and the starting end of each of the first beads or the starting end of each of the second beads is inclined with respect to the tearing direction at an angle ranging between 45 degrees and 85 degrees. A distance a between the finishing ends of the first beads and the center of the tab securing portion in the tearing direction is equivalent to or larger than the diameter of the tab securing portion and is not less than 4 mm.

3 Claims, 4 Drawing Sheets

NON-VENT TYPE FULLY OPENABLE EASY-OPENING END

BACKGROUND OF THE INVENTION

1. Field of the Invention

The present invention relates to an improved non-vent type fully openable easy-opening end which requires a reduced force for breaking off an end after initial rupture and which can thus be removed easily and smoothly.

2. Description of the Related Art

Easy-opening ends can be removed by means of a pulling force which is exerted by a user using his or her finger without the use of a tool such as a can opener. Because of their handiness, such ends have been widely used for soda cans, beer cans and the like in recent years. The end structure of the above-described type falls into two classes: an end which is partially removed to enable opening of a can (hereinafter referred to as P-EOE and an end which is entirely removed (hereinafter referred to as Fully openable easy-opening end or F-EOE).

The end structure of such a P-EOE has a removable portion and an opening tab secured to the removable portion. When the opening tab is lifted upwardly, the removable portion is pulled up and opening of the can is thereby initiated. Opening is completed by pulling the opening tab further. On the other hand, in the latter class (F-EOE) the forward end of the removable portion to which the opening tab is secured is bent inwardly relative to the can body when the opening is initiated. The entirety of the F-EOE can then be removed by pulling upwardly the inwardly bent removable portion.

Thus, opening of a F-EOE is initiated in a different way from what is done with a P-EOE. In a fully openable easy-opening end, the results of curvature of the stamped score shape is larger than the corresponding portion in a partially openable easy-opening end. Therefore stress is distributed over a considerable area when opening of the F-EOE is initiated, so that the initial opening force is higher than that of P-EOE. Further, since the area of removable portion of F-EOE is larger than that of the P-EOE, a greater force is required to tear off the removable portion after the initial opening.

For the above-described reasons, it is less easy to open a fully openable easy-opening end as compared with a partially openable easy-opening end.

Various attempts have been made to make it easier to open a fully openable easy-opening end. For example, Japanese Utility Model Laid-Open No. 57-43239 purposes a structure of a fully openable easy-opening end in which the score thickness near the opening portion is partially thinner than the score thickness around the end. Since the score near opening section is made partially thinner, a reduced force will suffice to initiate the rupture of the removable portion. Japanese Patent Laid-Open No. 52-94291 proposes a structure of a fully openable easy-opening end in which the distance between an end of a tab and an opening score is defined in such a manner as to improve the ease with which the fully openable easy-opening end can be opened. Japanese Patent Laid-Open No. 54-54786 discloses a non-vent type F-EOE in which auxiliary score and bead along the principal score are provided except the portion initially ruptured in such a manner that the length of auxiliary score is made shorter than the length of bead.

The stamping of the bead allows the principal score located in the vicinity of the initial opening portion to be stretched to a large extent and causes necking, thus improving the initial openability. However, this raises problems in that the principal score may easily rupture during handling of the can or in case that it falls for some reason.

The above-described proposals are effective in facilitating initiation of the opening of a F-EOE which is started by lifting an opening tab. However, they fail to reduce the force required to tear off the end after the initial opening.

The openability, which a user feels when he or she opens an easy-opening can, depends not only on the initial opening force which opening of the end is initiated but also on the force required to tear the end away from the can body after the initial opening. Even if the rupture of the end can be initiated with ease, if an increased amount of force is required to tear off the end, the impact or vibration of the can body generated during the can opening leads to spilling of the contents. In particular, the fully openable easy-opening end requires that a large amount of force be used to tear off the end because it has a large removable portion.

SUMMARY OF THE INVENTION

Accordingly, an object of the present invention is to provide a fully openable easy-opening end which makes it suffice to use a reduced level of force to tear off a removable portion and which thus improves the openability of F-EOE.

The present inventors found that the openability can be improved if a removable portion has two areas, one where the bending rigidity is high in the tearing direction and the other where the bending rigidity is low, and if the position of the boundary of the two areas is specified suitably. This enables the ease with which the end can be opened to be improved without injuring the mechanical strength of the principal score.

The present invention provides, in one of its aspects, a non-vent type fully openable easy-opening end in which a pair of beads are formed at the both sides of the tab securing portion symmetrically, so as to locally provide the area where the bending rigidity in the tearing direction is high, said pair of beads is formed in such a manner that the starting end of said beads is positioned on the straight line that connects the starting end of each of the beads and the forward end of the tab securing portion is inclined at an angle ranging between 45 degrees and 85 degrees with respect to the tearing direction. This straight line corresponds to the boundary line of the areas where the bending rigidity is different, and is represented by the line which connects the forward end of the tab securing portion and the starting end of each of the beads. At this time, the starting end of each of the beads may be located at any point on the straight line so long as it is on the inner side of the principal score. The longer the length of the beads the further and more widely the removable portion is broken at the initial stage of the can opening to increase the arm of the bending moment which acts on the removable portion when it is torn away after initial opening and thereby reducing the level of force required to tear off the removable portion after initial opening. Therefore in order to make the present invention effective, the distance between the finishing ends of the beads and the center of the tab securing portion is made equivalent to or larger than the diameter of the tab securing portion and is not less than 4 mm.

The present invention provides, in another of its aspects, a fully openable easy-opening end in which a pair of first beads are formed at both sides of the tab securing portion symmetrically and that they run in the tearing direction while a pair of second beads are provided on the periphery of the removable portion defined by a principal score in such a manner that they run along the principal score, the second beads being formed at both sides of the tab securing portion symmetrically, the first and second beads being formed in such a manner that the straight line that connects the starting end of each of the first beads or that of each of the second beads and the forward end of the tab securing portion is inclined at an angle $\theta$ ranging between 45 degrees and 85 degrees with respect to the tearing direction. The straight line corresponds to the boundary line of the areas where the bending rigidity is different, and is represented by either the line that connects the forward end of the tab securing portion and the starting end of each of the first beads or the line which connects the forward end of the tab securing portion and the starting end of each of the second beads which is inclined at a smaller angle with respect to the tearing direction. At this time, the starting ends of the two beads may be located at any point on the straight lines so long as they are on the inner side of the principal score.

In the present invention, provision of the first beads is essential. Therefore, in another aspect of the present invention, the distance between the finishing ends of the first beads and the center of the tab securing portion is also made equivalent to or larger than the diameter of the tab securing portion and is not less than 4 mm.

The larger the number of beads, the greater the rigidity of the removable portion. However, two pairs of them will be sufficient.

DESCRIPTION OF THE PREFERRED EMBODIMENTS

Figure 1:
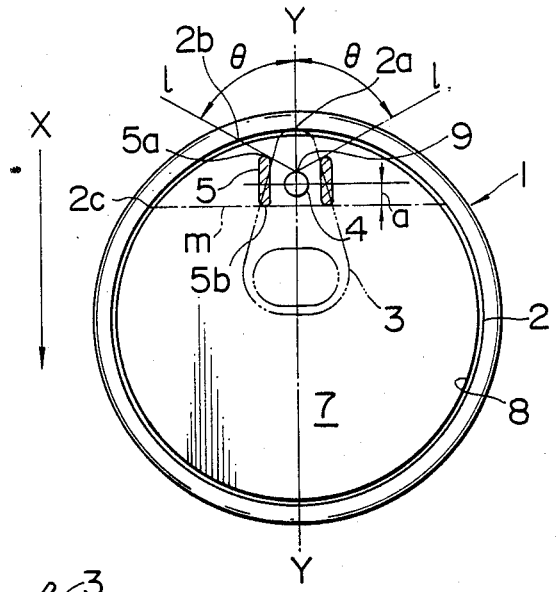
FIG. 1 is a plan view of a fully openable easy-opening end, showing a first embodiment of the present invention.

A first embodiment of the present invention will be described first with reference to FIG. 1. A principal score 2 is impressed around the periphery of a F-EOE 1. An opening tab 3 is secured to the F-EOE 1 at a tab securing portion 4 which is located in the vicinity of part of the principal score 2. A pair of beads 5 is provided at the two sides of the tab securing portion 4 symmetrically with respect to an axis Y—Y which is parallel to a tearing direction X. A straight line l which connects a starting end 5*a* of each of the beads 5 and the forward end 9 of the tab securing portion 4 is inclined at an angle $\theta$ with respect to the axis Y—Y.

Figure 2:
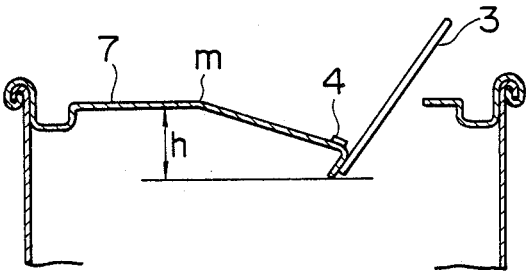
FIG. 2 is a cross-sectional view of the F-EOE of FIG. 1, showing how a removable portion is deformed after initial opening.

Next, the manner in which the F-EOE 1 is opened will be described. When the user engages his or her finger with the handle of the opening tab 3 and lifts it upwardly, rupture of the principal score is initiated at an initial rupture starting point 2*a*, and then proceeds to the vicinity of intersections 2*b* where the straight lines l cross the principal score 2. The rupture further proceeds to intersections 2*c* and the opening tab 3 is pushed forward further at which point the initial rupture is completed. FIG. 2 shows how the removable portion is deformed when the initial rupture is completed. The intersections 2*c* represent the points at which a straight line m which passes the finishing ends 5*b* of the beads 5 crosses the principal score 2 and at which initial rupture is substantially completed. In other words, the straight line m corresponds to a bending line formed on a removable portion 7 after the initial opening, as shown in FIG. 2. In this way, the arm of the bending moment which is exerted on the removable portion 7 when the opening tab 3 is pulled up so as to tear off the removable portion is increased, and the force required to tear off the removable portion after initial rupture is greatly reduced.

A second embodiment of the present invention will be described below with reference to FIG. 3 in which the same reference numerals are used to denote the components identical to those in FIG. 1. The principal score 2 is impressed around the periphery of a F-EOE 1A. The opening tab 3 is secured to the F-EOE 1A at the tab securing portion 4 formed in the vicinity of a part of the principal score 2. A first pair of beads 5 near the tab securing portion 4 and a second pair of beads 6 along the principal score 2 are formed, respectively, in such a manner that they are symmetrical with respect to the axis Y—Y which runs parallel to the tearing direction X. The straight line l which connects the starting end 5*a* of each of the first beads 5 and the forward end 9 of the tab securing portion 4 is inclined at an angle $\theta$ with respect to the axis Y—Y.

When the user engages his or her finger with the handle of the opening tab 3 and lifts it upwardly, rupture is initiated at the initial rupture starting point 2*a*, and then gradually proceeds along the principal score 2 to the vicinity of the intersections 2*b* at which the straight lines l cross the principal score 2. As the opening tab 3 is further pushed forward, rupture further proceeds to the vicinity of intersections 2*d* from the intersection 2*b* due to an increased bending rigidity of the removable portion 7 with respect to the tearing direction X by the provision of the two pairs of beads 5 and 6, and is then completed. The intersection 2*d* represent the points at which a curved bending line n that passes the finishing ends 5*b* of the first beads and the finishing ends 6*b* of the second beads crosses the principal score 2, as shown in FIG. 3, and at which the initial rupture is substantially completed. Since the arm of the bending moment that acts on the removable portion 7A when the opening tab 3 is further pulled upwardly after the initial rupture so as to tear off the removable portion 7A is increased, the force required to tear off the removable portion after initial rupture is greatly decreased.

In this embodiment, it is important to suitably specify the angle $\theta$ and the distance a between the finishing ends 5*b* of the first beads 5 and the center of the tab securing portion.

When the angle $\theta$ is large, the initial opening force which is started by the lifting of the opening tab 3 upwardly, in particular, the force required to rupture the score break from the intersections 2b to the intersections 2c, can be decreased. However, if the angle $\theta$ exceeds 85 degrees, the removable portion is bent at the portion located near the starting end 5a, and cannot be opened further at the initial rupture. As a result, the arm of the moment exerted on the removable portion when it tears is decreased, and reduction in the force required to tear off the removable portion after initial rupture cannot be achieved. On the other hand, if the angle $\theta$ is less than 45 degrees, the force required during the initial rupture, as well as the force required to initialize the rupture at the initial rupture starting position 2a, increases. It is therefore preferable for the angle $\theta$ to be specified between 45 degrees and 85 degrees. More preferably, it is set to a value ranging between 60 degrees and 80 degrees in order to balance the reduction in the initial opening force required during the initial rupture and the reduction in the force required to tear off the removable portion.

In the second embodiment, the two pairs of beads 5 and 6 are provided on the F-EOE in such a manner that at least either of the starting ends 5a and 6a of the two pairs of beads is located at any point on the straight line l. The starting ends 5a and 6a of the two pairs of beads 5 and 6 may be separated from each other, as shown in FIG. 3, or they may be continued.

Figure 4A:
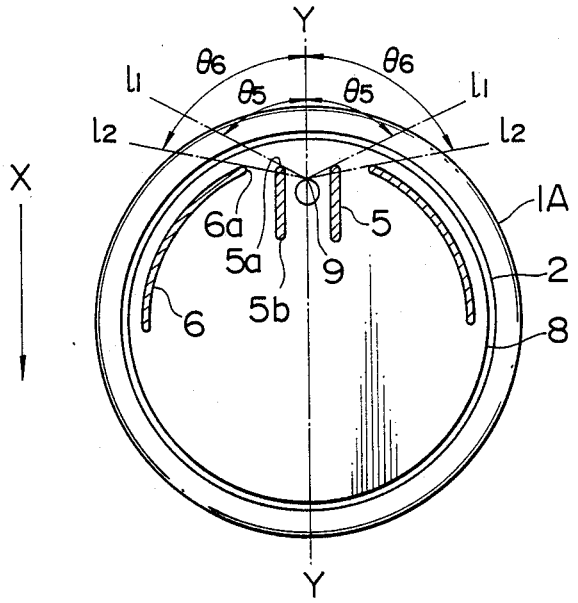
FIGS. 4*a* and 4*b* are plan views, explaining the angle $\theta$ for the second embodiment.
Figure 4B:
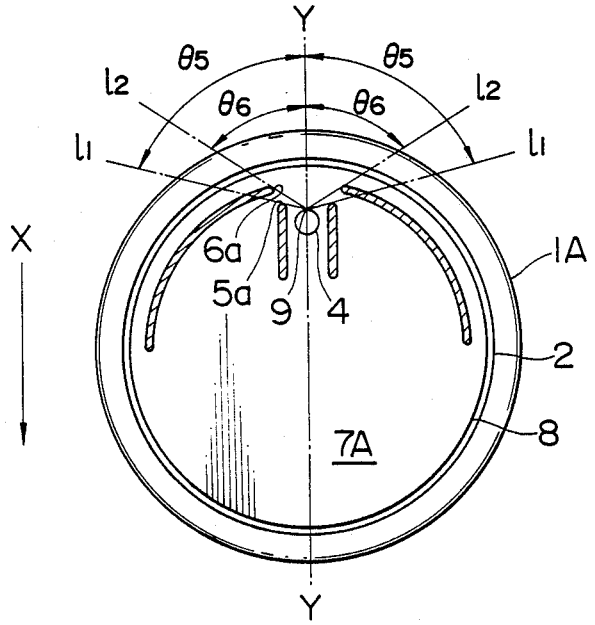

FIGS. 4a and 4b explain the angle $\theta$ in detail in the case where the starting ends 5a and 6a of the beads are separated from each other. In FIGS. 4a and 4b, $\theta_5$ is an angle formed between the axis Y—Y and the straight line $l_1$ that connects the starting end 5a of each of the first beads 5 and the forward end 9 of the tab securing portion 4, and $\theta_6$ represents an angle forward between the axis Y—Y and the straight line $l_2$ that connects the starting end 6a of each of the second beads 6 and the forward end 9 of the tab secured portion. In this invention, $\theta$ is equivalent to $\theta_5$ or $\theta_6$, whichever is the smaller.

The present invention is most effective when $\theta_5=\theta_6$ (which means $\theta=\theta_5=\theta_6$). However, even if $\theta_5<\theta_6$ (in this case, $\theta=\theta_5$), as shown in FIG. 4a, or $\theta_5<\theta_6$ (in this case, $\theta=\theta_6$), as shown in FIG. 4b, the present invention is sufficiently effective so long as $\theta$ is between 45 degrees and 85 degrees.

In the case of $\theta_5<\theta_6$, it is preferable for the starting end 6a of each of the second beads 6 to be located in the direction opposite to the direction X as viewed from the finishing end 5b of the first bead 5 (i.e., on the side of the tab-securing portion). In the case of $\theta_5>\theta_6$, it is preferable for the starting end 5a of each of the beads 5 to be located in the direction opposite to the direction X with respect to the straight line which passes the center of the tab securing portion 4 and runs perpendicular to the axis Y—Y (i.e., $\theta_5<90$ degrees).

In the first embodiment, provision of the first beads 5 is essential to provide a moment arm required to generate the bending moment when the removable portion is torn off. Provision of the beads 5 is also essential in the second embodiment.

In order to provide a sufficient moment arm, it is necessary for the distance a between the finishing end 5b of the first bead 5 and the center of the tab securing portion to be made equivalent to or larger than the diameter of the tab securing portion (which corresponds to the diameter of a hole of the opening tab) and to be not less than 4 mm (whichever is the larger). Preferably, $a \geqq 6$ mm.

Figure 5A:
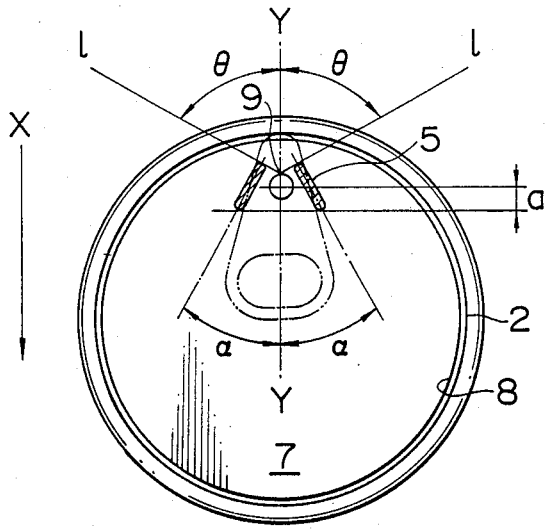
FIGS. 5*a* and 5*b* are plan views, explaining the angle $\theta$ for the first and second embodiments, respectively.
Figure 5B:
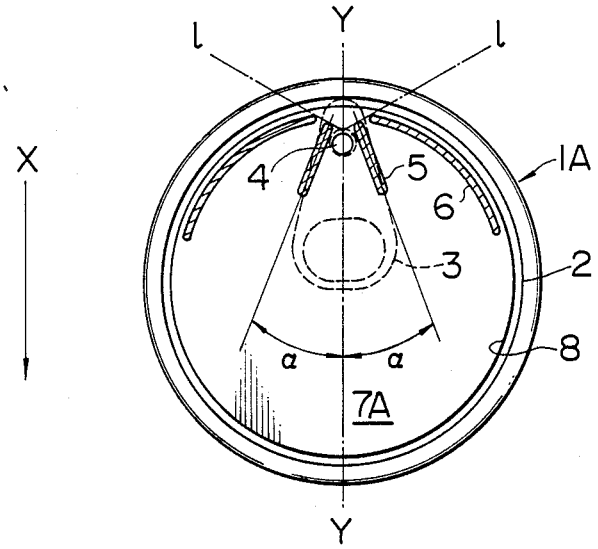

The beads 5 may be inclined at an angle $\alpha$ relative to the axis Y—Y, as shown in FIGS. 5a and 5b. The bending rigidity by the first beads 5 is maximized when the direction in which the beads 5 run is identical to the tearing direction X. However, the beads 5 may be strong enough not to be bent if the angle $\alpha$ is within $\pm 30$ degrees, as shown in FIG. 5a, or within $\pm 45$ degrees, as shown in FIG. 5b. However, if the angle $\alpha$ is less than $-10$ degrees, the first beads 5 will become an obstacle to rivetting the opening tab. In consequence, it is preferable for the angle $\alpha$ to be larger than $-10$ degrees. A negative value for the angle $\alpha$ means that the distance between the beads 5 becomes narrower in the tearing direction X, and a positive value for the angle means that the distance between the beads 5 becomes broader in that direction.

The greater the length of the first beads 5, the longer the moment arm of the bending moment exerted on the removable portion when it is torn, facilitating the tear of the removable portion. On the other hand, as the length of the first beads 5 becomes larger, the depth h at which the removable portion 7 is bent inwardly relative to a can body when the initial opening is completed becomes larger, increasing the possibility of the contents in the can being damaged. In the case where damaging of the contents must be avoided, the distance a is set to 25 mm or less in the first embodiment.

In the second embodiment, the pair of second beads 6 are formed in addition to the first beads 5 provided in the first embodiment.

The second beads 6 are provided along the principal score 2 for the purposes of increasing the bending rigidity of the removable portion along the principal score 2 so as to allow the removable portion 7A to break further and more widely during the initial rupture, as well as of more increasing the bending rigidity in addition to the first beads 5.

Provision of the beads 6 is particularly effective in the case where the diameter of the F-EOE 1A is large. It is preferable for the lower limit of the distance b between the finishing ends 6b of the second beads 6 and the center of the tab securing portion 4 to be set to 4 mm. In the case of a can which is model 307 or larger (which has a diameter 3 7/16 inches or more), the lower limit may be set to 6 mm or more.

In the second embodiment, the relationship between the distances a and b needs not be specified as long as the distance a satisfies the particular requirements in the present invention. That is, $a \geqq b$ or $a<b$ may suffice.

Figure 6A:
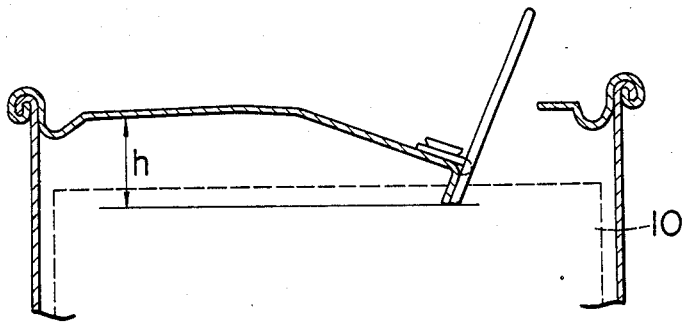
FIGS. 6*a* and 6*b* are cross-sectional views, showing how the removable portion is deformed after initial opening in the second embodiment.

As in the case of the first embodiment, the longer the length of the first beads 5 and/or the second beads 6, the longer the arm of the moment acting on the removable portion when it is torn, in the second embodiment, facilitating tear of the removable portion. However, as the length of the first beads 5 and/or the second beads 6 becomes larger, the depth h at which the removable portion 7 is bent inwardly relative to a can body when the initial rupture is completed becomes larger, as shown in FIG. 6a, increasing the possibility of the contents in the can being damaged. This is prevented in the second embodiment when the distance is is made smaller than the distance b. FIG. 6a shows how the removable portion 7 is bent after the initial rupture when the distance a is larger than the distance b. On the other hand, FIG. 6b illustrates how the removable portion 7A of the F-EOE shown in FIG. 3 is bent after the initial rupture in the case when a<b.

Figure 3:
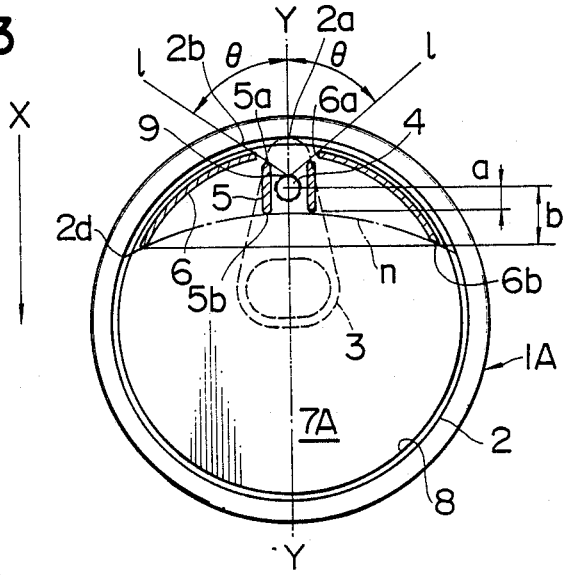
FIG. 3 is a plan view of the F-EOE, showing a second embodiment of the present invention.
Figure 6B:
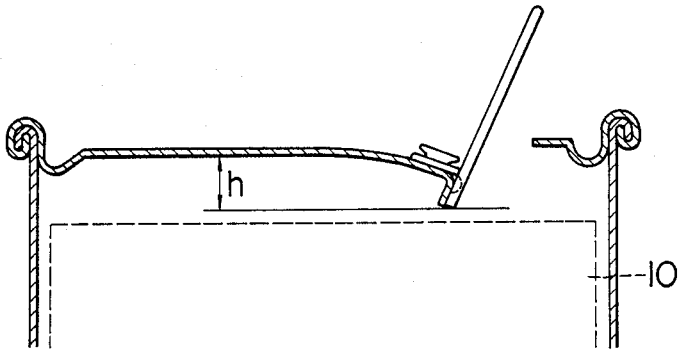

In the case of the F-EOE shown in FIG. 3. the bending line n is curved, and the removable portion 7A is therefore smoothly bent, as shown in FIG. 6*b*. As a result a moment arm is increased, while the depth h at which the removable portion is bent inwardly is decreased.

In the case where damage of the contents in a can has to be avoided, in the second embodiment, the distance a is made less than the distance b, the distance b being set to 25 mm or less while the distance a being set to 15 mm or less.

In the case where damage of the contents in a can has not be taken into consideration, it is not necessary to specify the upper limit of the distances a and b, and they may be extended to the vicinity of the end of the removable portion which has been broken. In that case, the right and left beads 6 may be coupled and be shaped into an arcuate form.

Thus, the present invention enables manufacture of a non-vent type fully openable easy-opening end which requires a reduced force to tear the removable portion and in which the damage to the contents may be avoided, if necessary.

In the present invention, an auxiliary score 8 may be provided along the principal score 2.

The fully openable easy-opening end according to the present invention can also be applied to a safety type F-EOE in which an injury caused by the cut edge of an end or that of a removed removable portion can be prevented.

In addition to F-EOE made of tin plate and aluminum, the present inventive F-EOE can be applied to the following material.

(1) Iron or an iron alloy, or a non-ferrous metal material such as aluminum or an aluminum alloy.

(2) A metal material described in Item (1) on which plating or surface processing such as coating has been conducted.

(3) A composite metal material which is the metal material described in Items (1) and (2) on which a layer of organic material such as resin has been laminated.

(4) A composite metal material composed of different metal materials described in Items (1) and (2).

EXPERIMENTAL EXAMPLES

Various model 301 F-EOE (having a diameter of 3 1/16 inches) were manufactured using the T-4 tin plate having a wall thickness of 0.23 mm of the first embodiment. The thickness of the residual metal of the principal score 2 was 50 μm. The force required to tear the removable portion after the initial rupture and the depth h at which the removable portion is bent inwardly relative to a can body after the initial opening were measured, and Table 1 shows the results of the measurement. Table 1 also contains the comparative example which employs a conventional F-EOE which has no beads. The experimental examples 1 to 4 employ the fully openable easy-opening end which is shown in FIG. 1.

TABLE 1

| Test | Angle θ | Distance a | Force required to tear | Depth h of bending |
|---|---|---|---|---|
| Comparative example | — | — | 5.4 Kgf | 7.0 mm |
| Experimental example 1 | 45° | 20 mm | 4.2 Kgf | 7.2 mm |
| Experimental example 2 | 80° | 25 mm | 4.1 Kgf | 7.5 mm |
| Experimental example 3 | 80° | 50 mm | 2.3 Kgf | 12.0 mm |
| Experimental example 4 | 60° | 15 mm | 4.3 Kgf | 7.2 mm |

As is clear from Table 1, in Experimental Examples 1 to 4, a force required to tear off the removable portion after the initial rupture is reduced, as compared with Comparative Example. In Experimental Examples 1, 2 and 4, the depth h at which the removable portion is bent inwardly remains substantially the same as that in the conventional F-EOE, and damage to the contents can be avoided.

EXPERIMENTAL EXAMPLES

Various model 301 F-EOE (having a diameter of 3 1/16 inches) were manufactured using the T-4 tin plate having a wall thickness of 0.23 mm of the second embodiment. The thickness of the residual metal of the principal score 2 was 50 μm. The force required to tear the removable portion after the initial rupture and the depth h at which the removable portion is bent inwardly relative to a can body after the initial opening were measured, and Table 2 shows the results of the measurement. Table 2 also contains the comparative example which employs a conventional F-EOE which has no beads. The experiment examples 5 to 8 employ the fully openable easy-opening end which is shown in FIG. 3.

TABLE 2

| Test | Angle | Distance a | Distance b | Force required to tear | Depth h of bending |
|---|---|---|---|---|---|
| Comparative example | | | | 5.0 Kgf | 7.0 mm |
| Experimental example 5 | 45° | 15 mm | 20 mm | 4.2 Kgf | 6.5 mm |
| Experimental example 6 | 80° | 15 mm | 20 mm | 4.1 Kgf | 6.9 mm |
| Experimental example 7 | 80° | 40 mm | 50 mm | 2.5 Kgf | 12.0 mm |
| Experimental example 8 | 60° | 10 mm | 20 mm | 4.3 Kgf | 6.2 mm |

As is clear from Table 2, in Experimental Examples 5 to 8, a force required to tear off the removable portion after the initial rupture is reduced, as compared with that in Comparative Example. In Experimental Examples 5, 6 and 8, the depth h at which the removable portion is bent inwardly remains substantially the same as that in the conventional F-EOE.

As can be understood from the foregoing description, since the fully openable easy-opening end according to the present invention has a pair of (or two pairs of) beads which start from defined points, the bending rigidity of the removable portion is increased, thereby reducing the force required to open the F-EOE after the initial rupture. Further, since the positions at which the beads end are defined, prevention of damage to the contents may be avoided, if necessary.

What is claimed is:

1. An easily removable non-vent type fully openable easy-opening end, comprising:

a principal score impressed around the periphery of said end;

a pair of first beads formed symmetrically at both sides of a tab securing portion of said end which is proximate to said principal score, said pair of beads running along a tearing direction, said tab securing portion having a center and a forward end and each of said pair of first beads having respective starting and finishing ends;

a pair of second beads formed on the periphery of a removable portion of said end defined by said principal score for running along said principal score, said pair of second beads being located symmetrically at both sides of said tab securing portion, each of said pair of second beads having respective starting and finishing ends;

wherein the forward end of said tab securing portion is connected to the starting end of each of said first beads and the starting end of each of said second beads along straight lines inclining with respect to the tearing direction at angles having a range between 45 degrees and 85 degrees; and wherein the finishing ends of said first beads and the center of said tab securing portion are separated along said tearing direction by a distance which is equivalent to or larger than the diameter of said tab securing portion and is not less than 4 mm.

2. An easily removable non-vent type fully openable easy-opening end according to claim 1, wherein said angle ranges between 60 degrees and 80 degrees.

3. An easily removable non-vent type fully openable easy-opening end according to claim 1, wherein the respective finishing ends of said second beads are separated from the center of said tab securing portion by a distance which is larger than the distance between the respective finishing ends of said first beads and the center of said tab securing portion.

* * * * *